US006722496B2

(12) United States Patent
Gantert

(10) Patent No.: US 6,722,496 B2
(45) Date of Patent: Apr. 20, 2004

(54) COMBINATION HARD AND SOFT WEAPON CASE

(75) Inventor: Patrick K. Gantert, LaCrosse, WI (US)

(73) Assignee: Kolpin Outdoors, Inc., Fox Lake, WI (US)

( * ) Notice: Subject to any disclaimer, the term of this patent is extended or adjusted under 35 U.S.C. 154(b) by 73 days.

(21) Appl. No.: 10/134,031

(22) Filed: Apr. 24, 2002

(65) Prior Publication Data

US 2003/0201198 A1 Oct. 30, 2003

(51) Int. Cl.[7] ..... B65D 85/00
(52) U.S. Cl. ..... 206/315.11; 206/317
(58) Field of Search ..... 206/317, 315.11, 206/523; 70/63–65, 67, 69, 75

(56) References Cited

U.S. PATENT DOCUMENTS

| | | | | | |
|---|---|---|---|---|---|
| 2,706,036 | A | * | 4/1955 | Neal | 206/317 |
| 3,744,687 | A | | 7/1973 | Oreck | |
| 3,811,562 | A | | 5/1974 | Smith | |
| 4,446,900 | A | * | 5/1984 | Markovich | 206/317 |
| 4,480,774 | A | * | 11/1984 | Smith et al. | 206/317 |
| D309,675 | S | | 8/1990 | Kolpin | |
| D320,113 | S | | 9/1991 | VanSkiver | |
| D347,322 | S | | 5/1994 | Fiore | |
| D358,255 | S | | 5/1995 | Sharp et al. | |
| 5,669,495 | A | * | 9/1997 | West | 206/317 |
| D413,020 | S | | 8/1999 | Kolpin | |
| 6,009,996 | A | * | 1/2000 | Purdy | 206/317 |
| D421,179 | S | | 2/2000 | Kolpin | |
| D448,163 | S | | 9/2001 | Kolpin | |
| D448,164 | S | | 9/2001 | Kolpin | |
| D448,165 | S | | 9/2001 | Kolpin | |
| D448,558 | S | | 10/2001 | Kolpin | |
| D448,559 | S | | 10/2001 | Kolpin | |
| D448,560 | S | | 10/2001 | Kolpin | |
| D448,561 | S | | 10/2001 | Kolpin | |
| D448,562 | S | | 10/2001 | Kolpin | |
| D452,290 | S | | 12/2001 | Kolpin | |
| 6,604,390 | B1 | * | 8/2003 | Nooner | 70/63 |

OTHER PUBLICATIONS

Kolpin Outdoor Innovation 2001 Product Catalog.
2000 Kolpin Product Catalog.
Plano Molding Company; Jan. 2001.

* cited by examiner

*Primary Examiner*—Luan K. Bui
(74) *Attorney, Agent, or Firm*—Brian G. Gilpin; Godfrey & Kahn, S.C.

(57) ABSTRACT

A combination weapons case for guns, bows, knifes or other tools having a flexible inner case and a hard outer case. The outer case includes a recessed area for receiving the inner case, and may feature a place for storing arrows or other accessories. The outer case may be fastened to an object such as an all-terrain vehicle and the inner case may be conveniently removed for easy transport in the field. The outer case and/or the inner case may be shaped like the object contained therein.

2 Claims, 5 Drawing Sheets

COMBINATION HARD AND SOFT WEAPON CASE

FIELD OF THE INVENTION

This invention relates generally to weapons cases, and more specifically to weapon cases for guns, rifles, bows or the like.

BACKGROUND OF THE INVENTION

Soft-sided cases for weapons are generally used for storage and transport. Generally, such cases protect the weapon from dust and dirt, and may be at least somewhat moisture resistant. These cases also protect the weapon from being scratched by relatively minor forms of contact. Soft cases are typically used for carrying a weapon into the field or into a practice area. However, soft cases cannot fully protect the weapon during transport on an airplane or the like, and weapons may be damaged or ruined if other luggage is piled on top of the weapon or if the cased weapon is carelessly handled by baggage carriers. Further, soft cases are flexible and may be opened with relative ease even when locked. Thus, soft cases are not very secure against tampering. Even if the soft case is locked, it could be opened with relative ease. This may be very dangerous for a family owning a weapon stored in such a case, or when leaving a weapon unattended on an all-terrain vehicle ("ATV"). Finally, it can be difficult to mount a soft case to an ATV or other vehicle.

Hard-sided transport cases for weapons are also known. These cases more fully protect the weapon against damage during shipment or transportation, and they are more secure against tampering than soft cases. Though a hard case can be more easily mounted to a vehicle, it is not practical when the user is travelling on foot because it is relatively bulky and awkward to carry in that situation.

Accordingly, a need exists for a weapons case that has the benefits of a soft case while at the same time offering the protection of a hard case.

SUMMARY OF THE INVENTION

The present invention is a weapon case generally constructed from an inner case designed to contain a weapon such as a gun, bow, knife, or the like, and an outer case that is designed to receive the inner case containing the weapon. The inner case is flexible and is easy to carry in the field. The inner case may also be designed so that it floats even when a weapon is contained inside.

The outer case may be relatively form-fitted to the shape of the weapon and inner case, or may be larger to accommodate other accessories that may be carried with the weapon. The outer case is preferably made from a molded plastic so that it is easy to incorporate features such as apertures for locks, feet and lashing loops, or to make a case a particular shape without having to join many pieces together.

While the present invention is particularly useful for hunting, other applications are possible and references to use with hunting weapons should not be deemed to limit the application of the present invention. The present invention may be advantageously adapted for use where similar performance capabilities and characteristics are desired and it my be adapted for use with other tools and equipment. These and other objects and advantages of the present invention will become apparent from the detailed description, claims, and accompanying drawings.

DESCRIPTION OF THE PREFERRED EMBODIMENTS

Figure 1:
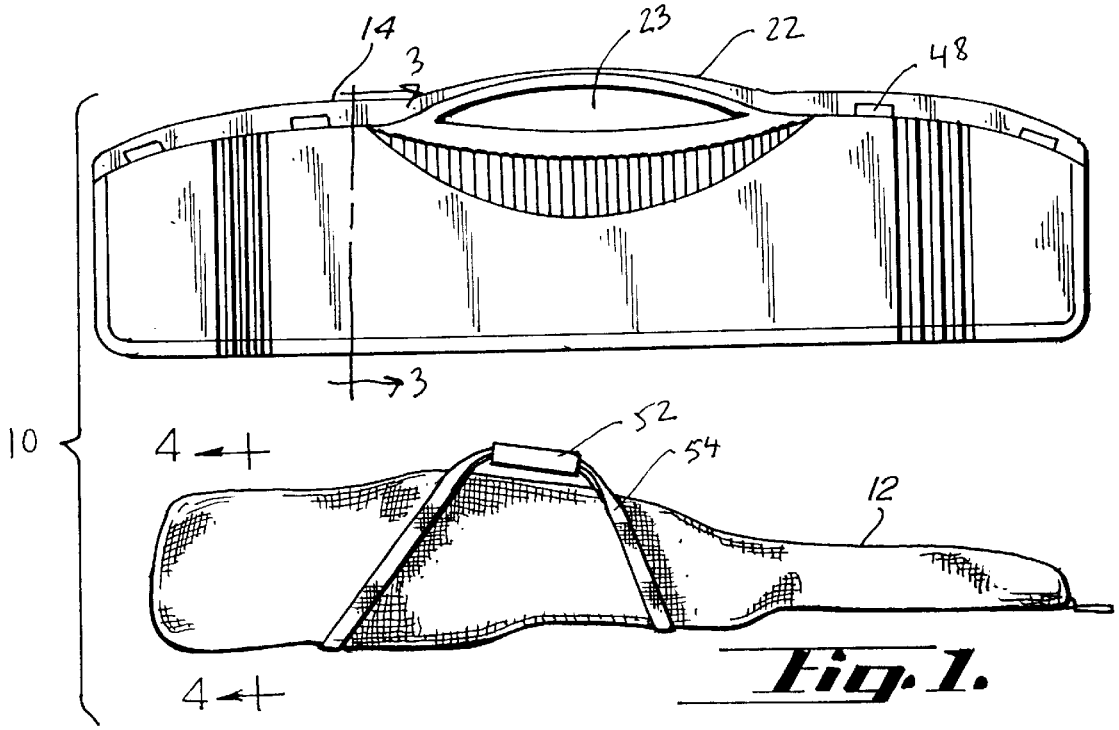
FIG. 1 is a plan view of an inner case and an outer case in accordance with one embodiment of the present invention, shaped to receive a rifle or shotgun.

Referring to FIG. 1, the present invention is a weapons case 10 that is a dual purpose weapons case for rugged transport and field duty. It is generally constructed from a relatively soft, flexible inner case 12 adapted to encase a weapon. The weapon may be a rifle as shown, but inner case 12 could be shaped to enclose any number of different weapons, such as shotguns, pistols, knives, swords, and compound, recurve or cross bows. Surrounding the inner case 12 is a relatively hard outer case 14. These two components are discussed more fully with reference to the several embodiments of the invention shown in FIGS. 1–12.

Figure 2:
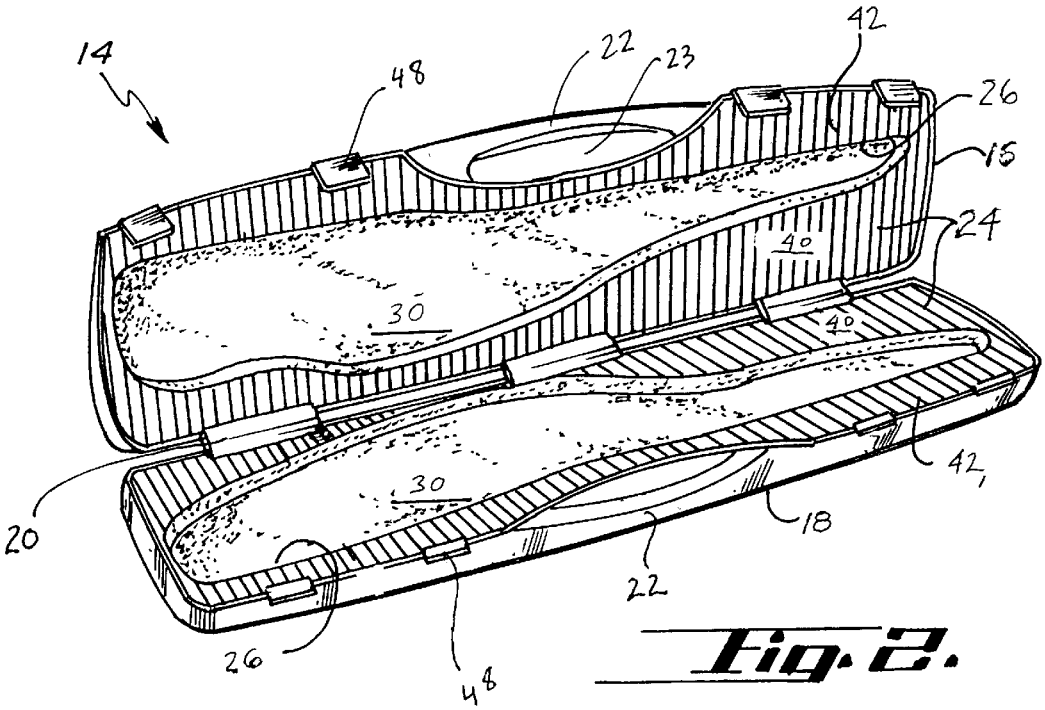
FIG. 2 is a perspective view of the outer case of FIG. 1, shown in an open position.

Referring to FIGS. 1 and 2, outer case 14 is constructed from a relatively hard material such as wood, metal or molded plastic. In the preferred embodiment, case 14 is made from polypropylene. Case 14 preferably has a clamshell construction formed by a top shell 16 and a bottom shell 18. Top shell 16 and bottom shell 18 may be hinged together with a series of hinges 20 or a continuous piano hinge (not shown). Hinges 20 may be cloth, molded into each cover and fit together with a pin, or any other type of hinge that is available. Top and bottom shells 16, 18 also include a handle 22 that may be integral with each shell 16, 18 as shown. The open area 23 below handle 22 is preferably large enough to accommodate a person's hand covered by a glove or mitten.

Figure 3:
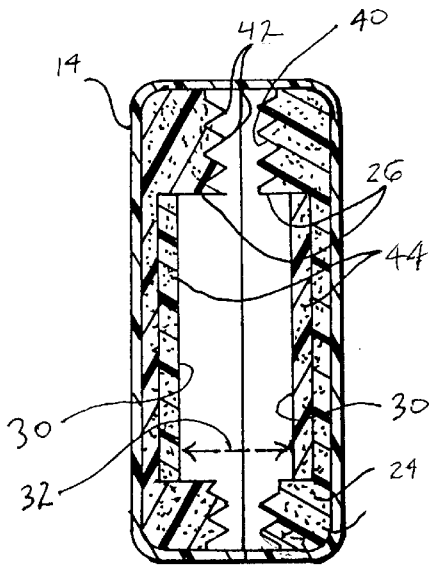
FIG. 3 is a cross-section of the outer case of FIG. 1, taken generally along the lines 3—3 of FIG. 1.

Each shell 16, 18 is preferably lined with a liner 24. The purpose of liner 24 is to prevent the inner case 12 holding an enclosed weapon from being jostled within the outer case 14 during transport. As seen in FIGS. 2 and 3, liner 24 generally fills each shell 16, 18 with the exception of a relief portion defined by edge 26 and surface 30. This relief portion accommodates case 12 when the outer case 14 is closed; thus, edge 26 is the same general shape as the outer perimeter of inner case 12. Preferably, when outer case 14 is in a closed position, the distance 32 between the surfaces 30 is about equal to the thickness 34 of inner case 12.

The remaining exposed surface 40 of liner 24 may be flat or have various textures such as the ribbed texture shown in FIG. 3. The ribbed texture allows the surface to be more compressible than a flat surface. The peak 42 of each rib may vary in shape or depth, and is not limited to the triangular peak shown. The advantage of having a ribbed surface 40 is that items can be placed between the shells 16, 18. Preferably, there is a gap between surfaces 40, or specifically, the peaks 42 when the outer case 14 is in a closed position. This allows for the storage of bulkier items between surfaces 40. However, the liner 24 could fill each shell 16, 18 completely (not shown) as long as it is compressible enough to receive a weapon encased in inner case 12.

Liner 24 may be made from foam, plush pile, fleece, or other soft, compressible material. Preferably, liner 24 is made from a combination of open-celled foam and closed cell foam. Open-celled foam is more easily compressed but is relatively easy to tear/gouge and can absorb liquid. Conversely, closed-cell foam is less easy to compress, but does not tear/gouge easily and does not absorb liquid. Thus, it is preferable to face certain surfaces with closed-cell foam for greater durability. For example, as seen in FIG. 3, at surface 30 is a closed-cell foam sheet 44, whereas the remainder of liner 24 is open-celled foam. Of course, liner 24 may be either completely open-celled foam or closed-cell foam, and sheet 44 could instead be made from a fabric or plush pile.

Referring to FIG. 2, outer case 14 is closed by at least one mating clasp 48 or the like. Preferably there is more than one clasp 48 along the length of the case 14 for a more secure closure. At least one of the clasps 48 may have a lock for added security and to prevent children from tampering with the weapon.

Figure 4:
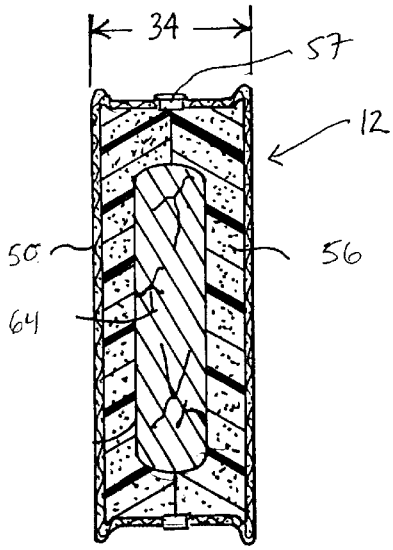
FIG. 4 is a cross-section of the inner case of FIG. 1, taken generally along the lines 4—4 of FIG. 1.

Referring now to FIGS. 1 and 4, inner case 12 is generally constructed from a soft outer material such as vinyl, leather, or a synthetic or natural fabric. The material used may be at least water resistant. In the most preferred embodiment, the material used is commonly known under the trademark CORDURA®. A handle 52 is attached by a strap 54 sewn to the exterior surface of case 12. Handle 52 is made from a leather or foam material, and is preferably large enough to accommodate a gloved hand. The interior surface of case is preferably lined with a closed-cell foam 56. This material is preferred because it floats, is relatively durable and water proof, and it can be shaped to generally match the profile of a particular weapon, if desired. In the most preferred embodiment, inner case 12 will float even when a weapon is encased therein. Other materials that may be used to line case 12 include fleece, plush pile, quilted batting or the like. Preferably, inner case 12 has a zipper closure (not shown), and most preferably, a zipper closure 57 that resists debris from entering the case.

During use, a weapon is placed in the inner case 12, which is then placed into the relief portion of shell 18. Shell 16 is closed, and the outer case 14 is latched shut by latches 48. Outer case 14 may be fastened to a vehicle such as an ATV, or carried separately. Preferably, outer case 14 is designed so that is can sit upright on the floor so that handle 22 in an upward position.

Figures 5, 6:
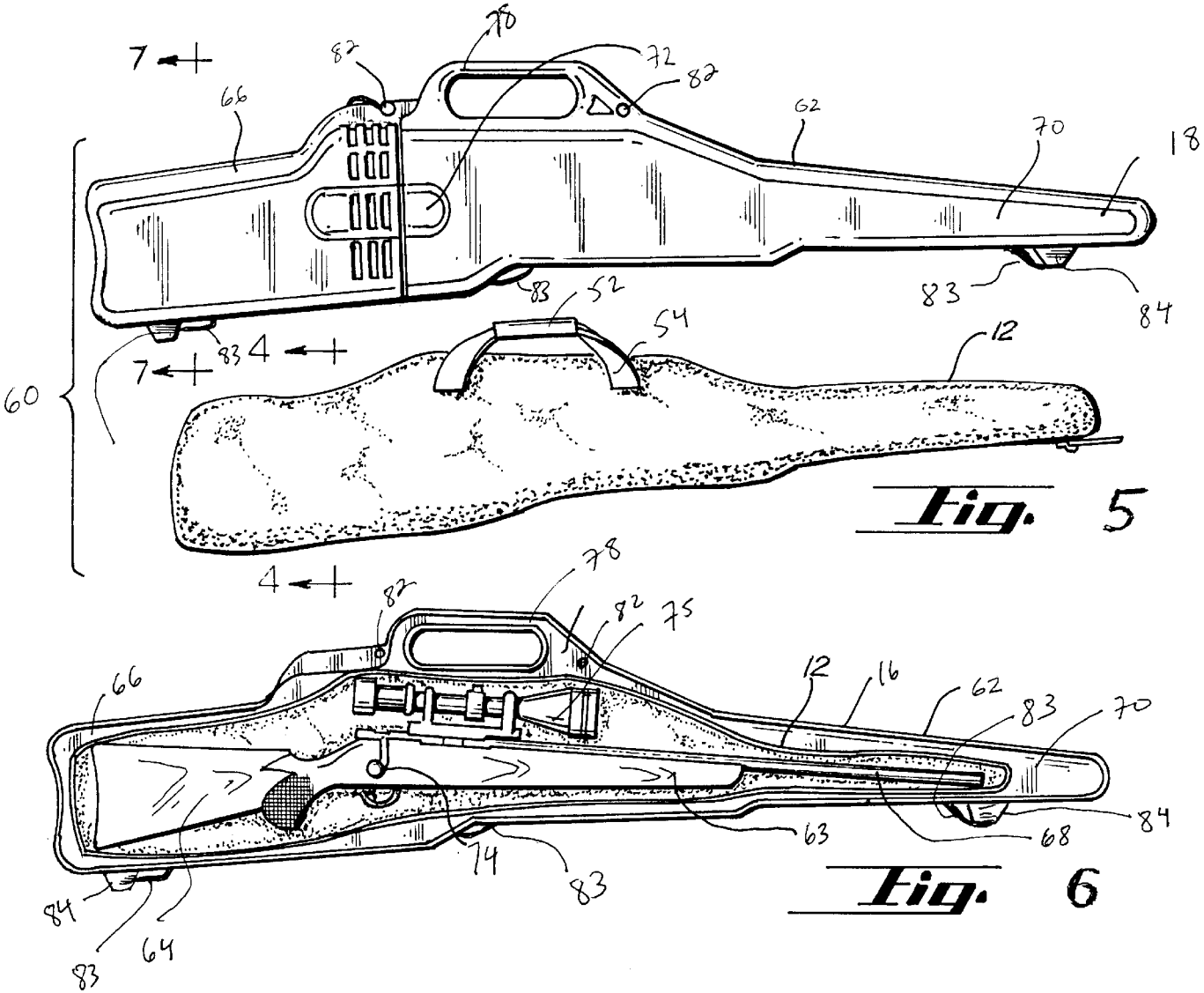
FIG. 5 is a plan view of the of an inner case and an outer case in accordance with another embodiment of the present invention, shaped to receive a rifle or shotgun.
FIG. 6 is a partial cutaway view of the outer case and the inner case of FIG. 5, with a scoped rifle stored therein.

Referring now to FIGS. 5 and 6, another embodiment of the present invention is shown. The general difference between case 10 and case 60 is that the shape of outer case 62 is more like shape of a rifle 63 or shotgun. Specifically, outer case 62 is preferably shaped to accommodate a right or left handed bolt-action rifle or shotgun. As seen in FIG. 6, the gun stock 64 is positioned in the stock portion 66 of case 62, and the barrel 68 is positioned in the barrel portion 70. An integral capsule portion 72 (located symmetrically on each shell 16, 18) accommodates the gun bolt 74. Preferably, there is enough room in inner case 12 and outer case 62 to accommodate a rifle or shotgun with a scope 75.

As with outer case 14, outer case 62 may have a handle 78 large enough to accommodate a gloved hand. Further, case 14 may have apertures 82 for receiving a padlock or the like, and several lashing loops 83 for lashing outer case 62 to another object such as a vehicle. In addition, case 62 may have feet 84 on the side opposite handle 78 so that the case can stand upright to present the handle 78.

Figure 7:
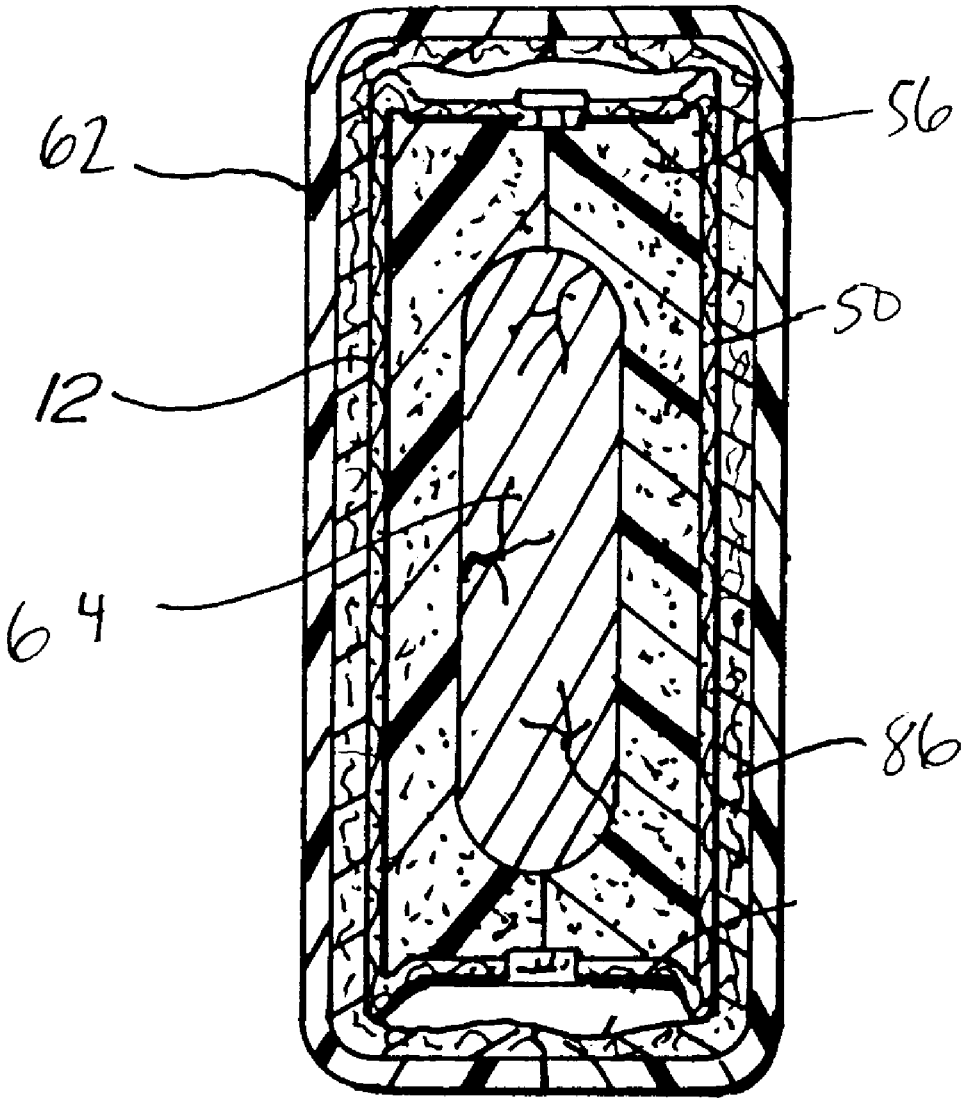
FIG. 7 is a cross-section of the outer case of FIG. 5 taken generally along lines 7—7, showing the inner case and a rifle stored therein.
Figure 11:
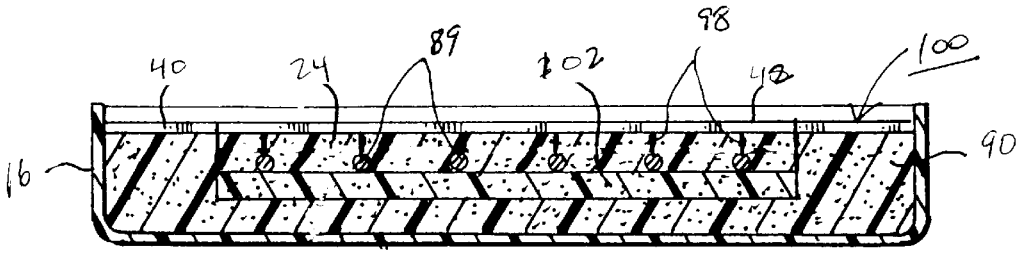
FIG. 11 is a cross-section of the top shell of the outer case in FIG. 8, taken generally along the lines 11—11 of FIG. 8.
Figure 10:
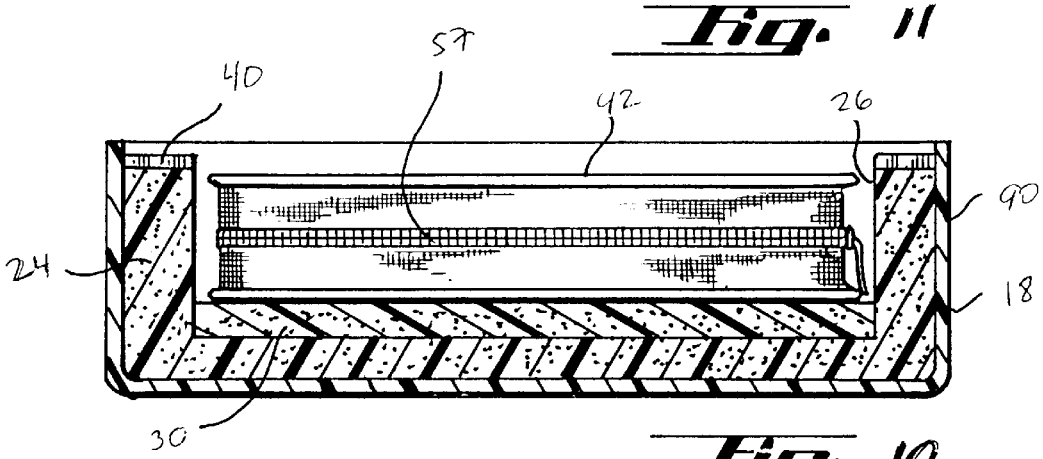
FIG. 10 is a cross-section of the bottom shell of the outer case, taken generally along the lines 10—10 of FIG. 8, and further including an end elevational view of the inner case of FIG. 9, placed therein.
Figure 9:
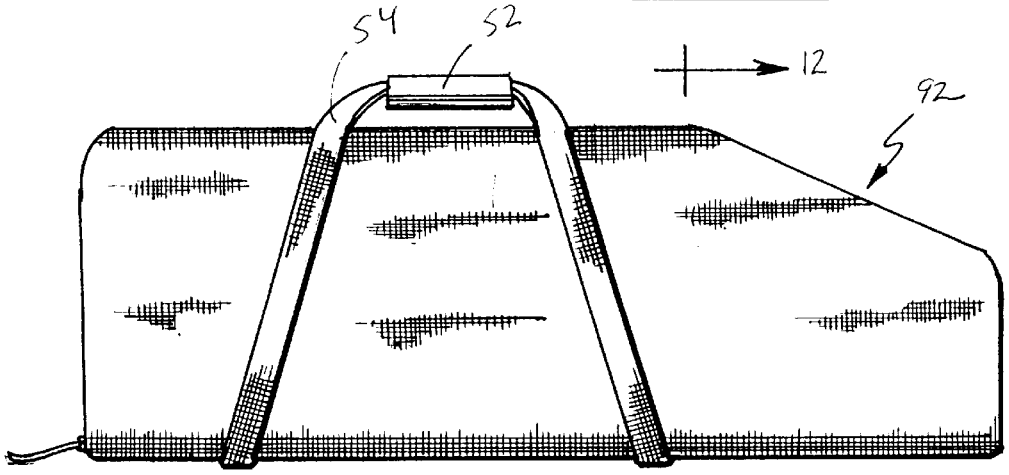
FIG. 9 is a plan view of a yet another embodiment of a soft, inner case in accordance with the present invention, for use with a bow in combination with the outer case shown in FIG. 8.
Figure 12:
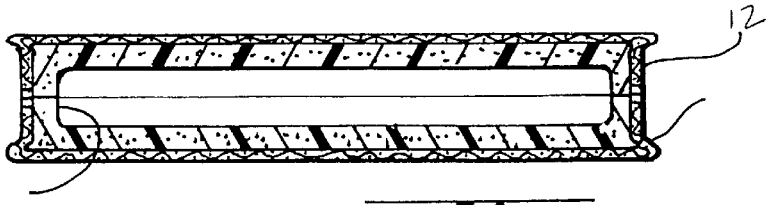
FIG. 12 is a cross-section of the inner case in FIG. 9, taken generally along the lines 12–12 of FIG. 9.

Case 62 may be unlined because of the relative form-fit of outer case 62 with respect to inner case 12, or may have a relatively thin liner 86 as seen in FIG. 7. Preferably, this thin liner is made of closed-cell foam, but may instead be an open-celled foam, fleece or plush pile lining. Inner case 12 fits inside case 62 so that there is a minimum of movement of case 12 or the weapon enclosed therein.

Referring now to FIGS. 8–12, another embodiment of the present invention is shown. This embodiment is very similar to that shown in FIGS. 1–4, except that it can be adapted to accommodate a bow (not shown) and arrows 89. Thus, many reference numbers will be duplicated in the following paragraphs.

As in the previously described two embodiments, case 90 is preferably made from polypropylene. Case 90 is large enough to accommodate a recurve or compound bow, along with other small accessories such as a quiver or the like. Like case 14, case 90 has a claim-shell construction formed by a top shell 16 and a bottom shell 18. Top shell 16 and bottom shell 18 may be hinged together in a similar manner as case 14, and also includes a handle 22. One additional feature that may be provided is recess 92 for the storage of arrows. Recess 92 is generally compromised of a first recess portion 94 and a second recess portion 96 separated by a slotted portion that includes slots 98.

Arrows 89 may be attached to top shell 16 by sliding the arrow shaft into any one of the slots 98. The foam liner 24 is preferably an open-celled foam so that it readily conforms around the arrow shaft 99 to hold in place. Recess portions 94 and 96 are of a depth so that the arrow fletching and broadheads may lie below the surface 100 of liner 24 in top shell 16. Preferably, recess portions 94 and 96 are lined with a closed-cell foam 102, or a fabric that resists abrasion from the broadheads and fletching.

Figure 8:
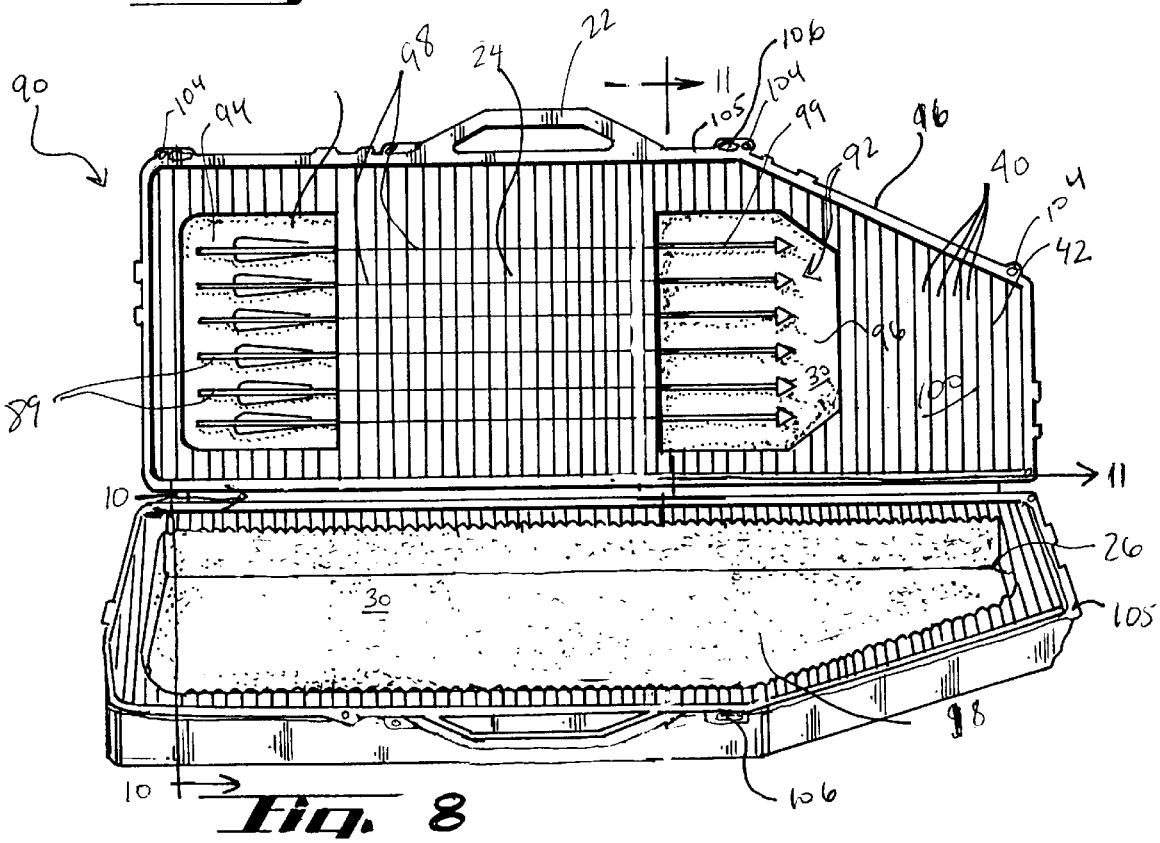
FIG. 8 is a perspective view of another embodiment of an outer case in accordance with the present invention, shaped to receive a bow.

As seen in FIG. 8, liner 24 generally fills bottom shell 18 with the exception of a recess defined by edge 26 and surface 30. Edge 26 is shaped to fit the perimeter of inner case 92 containing a compound or recurve bow, and other accessories such as a quiver or the like. Surface 30 of the relief portion is preferably lined with a closed-cell foam.

Other features of the outer case 90 shown in FIG. 8 include apertures 104 located on a protruding lip 105, the apertures used to accommodate a locking mechanism such as a padlock or other locking device. Further, lashing loops 106 are provided for lashing the case to another object.

Although the invention has been herein shown and described in what is perceived to be the most practical and preferred embodiments, it is to be understood that the invention is not intended to be limited to the specific embodiments set forth above. Accordingly, it is recognized that modifications may be made by one skilled in the art of the invention without departing from the spirit or intent of the invention and therefore, the invention is to be taken as including all reasonable equivalents to the subject matter of the appended claims.

What is claimed is:

1. A gun case comprising:

an inner case dimensioned to envelop a gun in an interior thereof, the inner case formed from a flexible material having a soft face which forms the interior of the inner case, the exterior shape of the inner case substantially reflecting the shape of the gun; and an outer case formed from an upper shell and a lower shell, the upper shell and lower shell hinged together and dimensioned to substantially envelop the inner case in an interior thereof, the outer case having an exterior formed from a substantially rigid material, and an interior surface lined with a foam material;

wherein at least the lower shell has a recess shaped to receive the exterior shape of the inner case.

2. A case for carrying a bow and arrows, the arrows having fletching at one end of an arrow shaft and a point at an opposite end of the arrow shaft, the case comprising:

a flexible inner case that can be selectively opened and closed, the inner case dimensioned to contain the bow; and a substantially rigid outer case that can be selectively opened and closed, the outer case having a top shell and a bottom shell each lined with a foam material;

wherein the top shell is adapted for storing a plurality of the arrows in a side-by-side configuration, wherein the foam material of the top shell has a first recess therein to accommodate the arrow fletching, and a second recess to accommodate the arrow point, the first recess and the second recess separated by a slotted portion with a plurality of slots, wherein an arrow shaft can be held within each of the plurality of slots; and wherein the bottom shell has a recess for receiving the flexible inner case.

* * * * *